US006561855B1

(12) United States Patent
Cret

(10) Patent No.: US 6,561,855 B1
(45) Date of Patent: May 13, 2003

(54) CLAMPING MECHANISM FOR USE WITH A TERMINAL SECURED TO A BATTERY POST AND INCORPORATING CONTROLLED ENGAGEMENT AND SPRING BACK CHARACTERISTICS

(75) Inventor: Gavril Cret, Sterling Heights, MI (US)

(73) Assignee: Alcoa Fujikura Limited, Franklin, TN (US)

( * ) Notice: Subject to any disclaimer, the term of this patent is extended or adjusted under 35 U.S.C. 154(b) by 0 days.

(21) Appl. No.: 10/116,347

(22) Filed: Apr. 4, 2002

(51) Int. Cl.[7] ..... H01R 4/42
(52) U.S. Cl. ..... 439/762
(58) Field of Search ..... 439/762, 774, 439/772, 761, 765, 770

(56) References Cited

U.S. PATENT DOCUMENTS

| | | | | |
|---|---|---|---|---|
| 3,838,386 | A | 9/1974 | Chartrain et al. | 339/226 |
| 4,983,086 | A | 1/1991 | Hatrock | 411/366 |
| 5,290,646 | A | 3/1994 | Asao et al. | 429/178 |
| 5,454,741 | A | 10/1995 | Okada | 439/762 |
| 5,595,510 | A | 1/1997 | Obligar | 439/761 |
| 5,800,219 | A | 9/1998 | Siedlik et al. | 439/762 |
| 5,879,202 | A | 3/1999 | Zhao | 439/762 |
| 5,897,403 | A | 4/1999 | Kourimsky | 439/761 |
| 5,934,947 | A | 8/1999 | Liang | 439/762 |
| 5,941,738 | A | 8/1999 | Matsunaga et al. | 439/762 |
| 6,152,785 | A | 11/2000 | Haller et al. | 439/766 |
| 6,155,889 | A | 12/2000 | Scarla et al. | 439/774 |
| 6,174,207 | B1 | 1/2001 | Cleveland | 439/773 |
| 6,200,173 | B1 | 3/2001 | Frisby | 439/762 |

*Primary Examiner*—Gary Paumen
*Assistant Examiner*—James R. Harvey
(74) *Attorney, Agent, or Firm*—Douglas J. McEvoy; Tracey D. Beiriger

(57) ABSTRACT

A clamping mechanism for use with a terminal secured to a battery post. The terminal includes a first end securing a terminal line, a substantially annular shaped post fitting proximate a second end, and which includes a pair of spaced apart guide walls from which extend first and second spaced apart and extending legs. The clamping mechanism has a body supported in laterally traversable fashion upon the first terminal leg, an elongated aperture defined therethrough permitting the body to be seatingly engaged through a terminal post extending upwardly from the first leg. The body fixedly engaging the second terminal leg. A pair of angling guides extend along the walls defining the aperture. A nut assembly is threadably engaged over the terminal post and includes a pair of additional guides which inter-engage the aperture angling guides along a traveling direction of the slotted portion. The nut assembly is rotated between first and second opposite and translating directions along the post such that the inter-engaging guides actuate the body between loosened and tightened positions in a controlled manner and with a controlled degree of clamping and spring back forces.

14 Claims, 5 Drawing Sheets

CLAMPING MECHANISM FOR USE WITH A TERMINAL SECURED TO A BATTERY POST AND INCORPORATING CONTROLLED ENGAGEMENT AND SPRING BACK CHARACTERISTICS

FIELD OF THE INVENTION

The present invention relates generally to battery terminal clamping mechanisms, such as are known for securing associated and encircling legs of the terminal about an upwardly, generally conically, extending battery post. More particularly, the present invention discloses an improved clamping mechanism for securing, in a tightened position, the terminal legs about the post in a non-destructive fashion, and which further provides, in a loosened position, for controlled spring-back of the terminal legs from about the battery post.

BACKGROUND OF THE INVENTION

The prior art is fairly well documented with numerous examples of battery terminal clamping mechanisms. As is known in the art, a suitable clamping mechanism is necessary in many battery terminal applications and in order to ensure the establishment of a continuous and electrically conductive communication between the battery and its associated terminal line.

Referring to FIG. 1 of the present drawing illustrations, entitled Prior Art, an illustration is provided at 2 of a conventional battery terminal and which is suitable for engaging such as a generally conical shaped post (see at 3 in FIG. 8), the post 3 in turn corresponding to either a positive or negative terminal of an associated battery (not shown). The terminal 2 is typically constructed of a suitable and copper stamped material, having a substantially elongated and flattened body and exhibiting the necessary properties of electrical conductivity and resiliency. The terminal 2 is also preferably tin plated and, in structure, terminates at one end in a pair of extending and bendable gripping tabs 4 which, upon being folded towards each other as shown in FIG. 8, grippingly secure an extending end of an associated terminal line 5.

The conventional terminal 2 further includes, at another end, a substantially annular shaped post fitting, defined by an upwardly and generally annular shaped wall 6 with an open interior. An inner annular surface 8 of the post fitting is preferably defined by a plurality of spaced apart serrations 8, one purpose for which being to provide a degree of anti-rotative engagement with the post 3 to which it is secured. A pair of spaced apart guide walls 10 and 12 define a slot therebetween, the slot facilitating actuation of the terminal between the tightened and loosened positions during both installation and removal from the battery post 3.

The terminal 2 further includes such features as a first leg, typically provided as a plate 14 and which is communicable with the first spaced apart guide wall 10 and terminates in an upwardly angled tab 16. A second extending leg (such as further defined by plate 18) is likewise communicable with the second spaced apart guide wall 12 and extends in substantially parallel spaced apart fashion (see also exploded view of FIG. 3) before terminating in a slightly forwardly extended position beyond the upwardly angled tab 16. A threaded post 20 extends upwardly from the second plate 18 proximate its forward terminating end.

Having described with sufficient detail the several features of the stamped terminal 2, reference is again made to a prior art clamping mechanism, illustrated in part by a slider mechanism 24 supported upon an upper surface of the second plate 18 and including a lengthwise extending slot 26 through which is received the upwardly angled tab 16 and to permit the slider mechanism 24 a range of laterally displaceable motion. The slider mechanism 24 defines an overall arcuate configuration and includes an enlarged rounded end, through which is formed a central, and somewhat elongated, aperture defined by tapered extending sides 28.

The clamping mechanism further includes a hex head nut 30 exhibiting a downwardly extending and tapered ledge 32 and which, upon being threadably engaged over the post 20, is tightened in a downward direction. Upon coming into contact with an uppermost location of the tapered extending sides 28 of the sliding mechanism aperture, continued rotation of the nut 30 in the tightening direction causes the tapered ledge 32 of the hex nut 30 to travel along the downward slope established by the tapered sides 28. This in turn causes the slider mechanism 28 to laterally displace in the direction of the second plate 18, in turn causing the angled tab 16 and associated first plate 14 to close in pincer fashion against the second plate 18.

Loosening of the slider mechanism 24 is accomplished by reverse rotation of the hex nut 30, thus causing a reverse travel of the associated tapered ledge 32 in a reverse and upwardly sloping direction along the tapered sides 28 of the slider mechanism aperture. Reference is also made to U.S. Pat. No. 5,879,202, issued to Zhao, and which discloses the battery terminal connector according to that as substantially described above.

While providing, at least initially, an effective clamping mechanism for use with a battery terminal, the terminal arrangement of FIG. 1 suffers from certain shortcomings arising primarily from the nature of the material properties of the terminal 2. These include the gradual inability of slider mechanism 24 to "spring back" to its loosened position following threaded disengagement of the hex nut 30.

Inadequate spring back of the terminal is further largely a result of plastic deformation (creep) of the metal in the terminal 2 after extended periods of time in the tightened position. As such, it has been found necessary to employ a secondary tool of some nature to forcibly pry open the associated legs (plates 14 and 18) of the terminal 2 and in order to achieve the desired spacing between the guide walls 10 and 12 to facilitate the removal of the terminal 2 from the battery post 3. The less than optimal desired degree of spring back additionally causes a permanent deformation on the terminal's extruded diameter (in proximity of the connection between the post fitting and the associated plates 14 and 18), such that the fit of the terminal 2 about the battery post 3 is successively degraded.

Inadequate spring back in the stamped terminal (again as a symptom of plastic deformation of the terminal 2) also results from excessive clamping torque applied to the mechanism during the initial tightening stage. It has also been found that such excessive clamping torque also results in the inner annular and serrated surface 8 of the post fitting biting into the lead composition of the battery post 3, often causing damage to the post 3, an accumulation of such damage eventually leading to the non-usability of the battery. Accordingly, an evident shortcoming in the prior art is the provision of a clamping mechanism, which possesses the ability to maintain a measured degree of clamping and holding forces and, by avoiding over-torquing of the terminal, prevents plastic deformation of the terminal.

SUMMARY OF THE INVENTION

The present invention, as previously described, discloses a clamping mechanism for securing associated and encircling legs of a battery terminal about an upwardly, generally conically shaped battery post. More specifically, the present invention discloses an improved clamping mechanism for securing, in a tightened position, the terminal legs about the post in a regulated and non-destructive fashion, and which further provides for controlled spring-back of the terminal legs from about the battery post in a loosened position.

As also previously described, the ability to regulate the degree of clamping force exerted upon the terminal sleeve serves to assist in preventing plastic deformation of the sleeve (see again at 2) and, during loosening of the clamping mechanism, avoids the necessity of employing an additional tool (such as a screw driver or other pointed utensil) and in order to disengage the extending sides of the terminal post fitting from about the battery post. An additional advantage of the present invention is that it prevents undesirable damage to the battery post resulting from such over-torquing and clamping of the sleeve thereabout.

As described in the preceding description of the prior art, the conventional battery terminal includes a first end grippingly securing the terminal line. A substantially annual shaped post fitting is located proximate a second end of the battery terminal and included a pair of spaced apart guide walls communicable with the first and second spaced apart and extending legs, the first leg further including an upwardly extending and exteriorly threaded post.

The clamping mechanism includes a three dimensional and substantially elongated slider supported in laterally traversable fashion upon the first terminal leg. The slider includes a substantially elongated aperture defined therethrough and so that the slider is engaged through the terminal post and in seating fashion upon the plate (such as again at 18) further defining the second terminal leg. The slider is also fixedly engaged to an upwardly angled tab extending from a terminating edge of the second terminal leg (plate 16). The slider aperture further includes a pair of angling guides in the form of angled and recessed slots extending along opposing and inwardly facing sides of the aperture.

A nut assembly is threadably engaged over an extending end of the terminal post. The nut assembly includes a hex head, an intermediate an enlarged disk shaped portion and an extending and cylindrically shaped portion. A washer is secured in axially fixed and freely rotatable fashion to the cylindrical shaped portion. The washer further exhibits a pair of laterally extending wings seating, respectively, within said angled and recessed slots defined in the slider aperture.

In use, the nut assembly is rotated about the post so as to translate in first and second opposite directions and such that the inter-engaging guides actuate the slider between corresponding loosened and tightened positions. The slider is thereby laterally traversed in a controlled manner and with a controlled degree of clamping force being applied to the battery terminal, upon the second leg being forcibly drawn in a direction towards the first selected leg. Furthermore, a controlled spring back of the slider, to the loosened position, is accomplished upon the nut assembly being rotated in the second translating direction.

BRIEF DESCRIPTION OF THE DRAWINGS

Reference will now be made to the attached drawings, when read in combination with the following detailed description, wherein like reference numerals refer to like parts throughout the several views, and in which.

DETAILED DESCRIPTION OF PREFERRED EMBODIMENT

Figure 2:
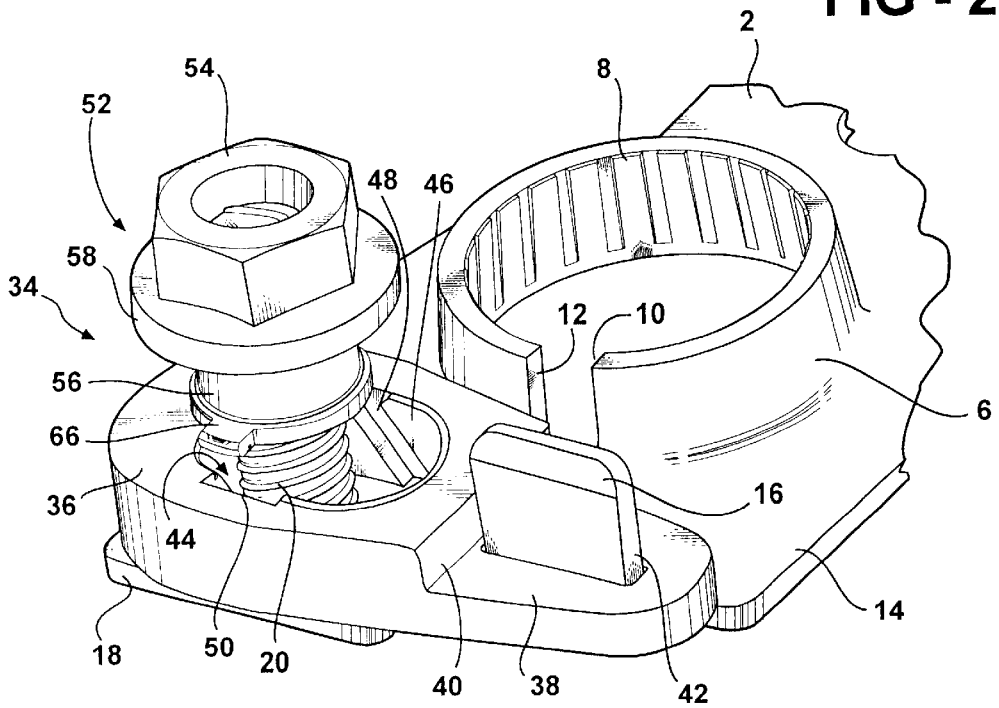
FIG. 2 is perspective view of the clamping mechanism for use with the conventionally known battery terminal and according to the present invention.
Figure 8:
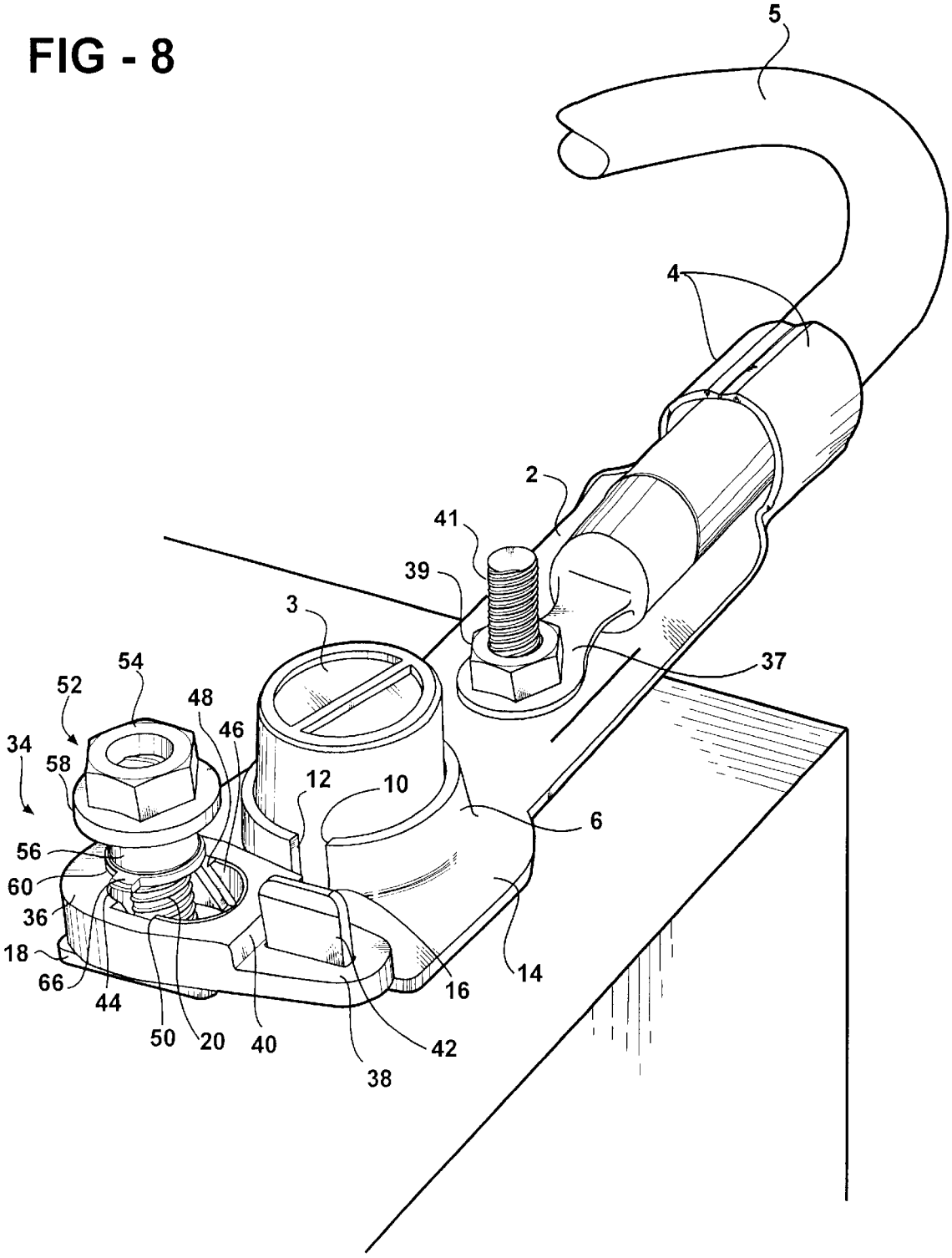
FIG. 8 is an assembled view of the stamped terminal upon the associated battery post and showing the terminal line grippingly secured to the terminal.

Reference now being made to FIG. 2, a clamping mechanism is illustrated generally at 34 for use with a terminal 2 (such as again a conventionally copper or spring steel stamped terminal) and in order to secure the terminal about a conventional battery post (see also again FIG. 8). As also previously described, the present invention discloses an improved clamping mechanism for securing, in a tightened position, the associated terminal legs (slotted post fitting 6 with extending plates 14 and 18) about the post in a non-destructive fashion, and which further provides, in a loosened position, for controlled spring-back of the terminal legs from about the battery post.

As best again referenced in FIG. 8, the battery terminal line 5 previously referenced includes a substantially flattened end 37 (usually constructed of a conductive copper or spring steel material) with a central through aperture (not shown). A nut 39 rotatably engages over a threaded post 41 extending upwardly from the terminal (see also aperture 43 in terminal 2 in Prior Art view of FIG. 1) and, upon being tightened, secures the flattened end 37 of the line 5 to the terminal 2.

Figure 3:
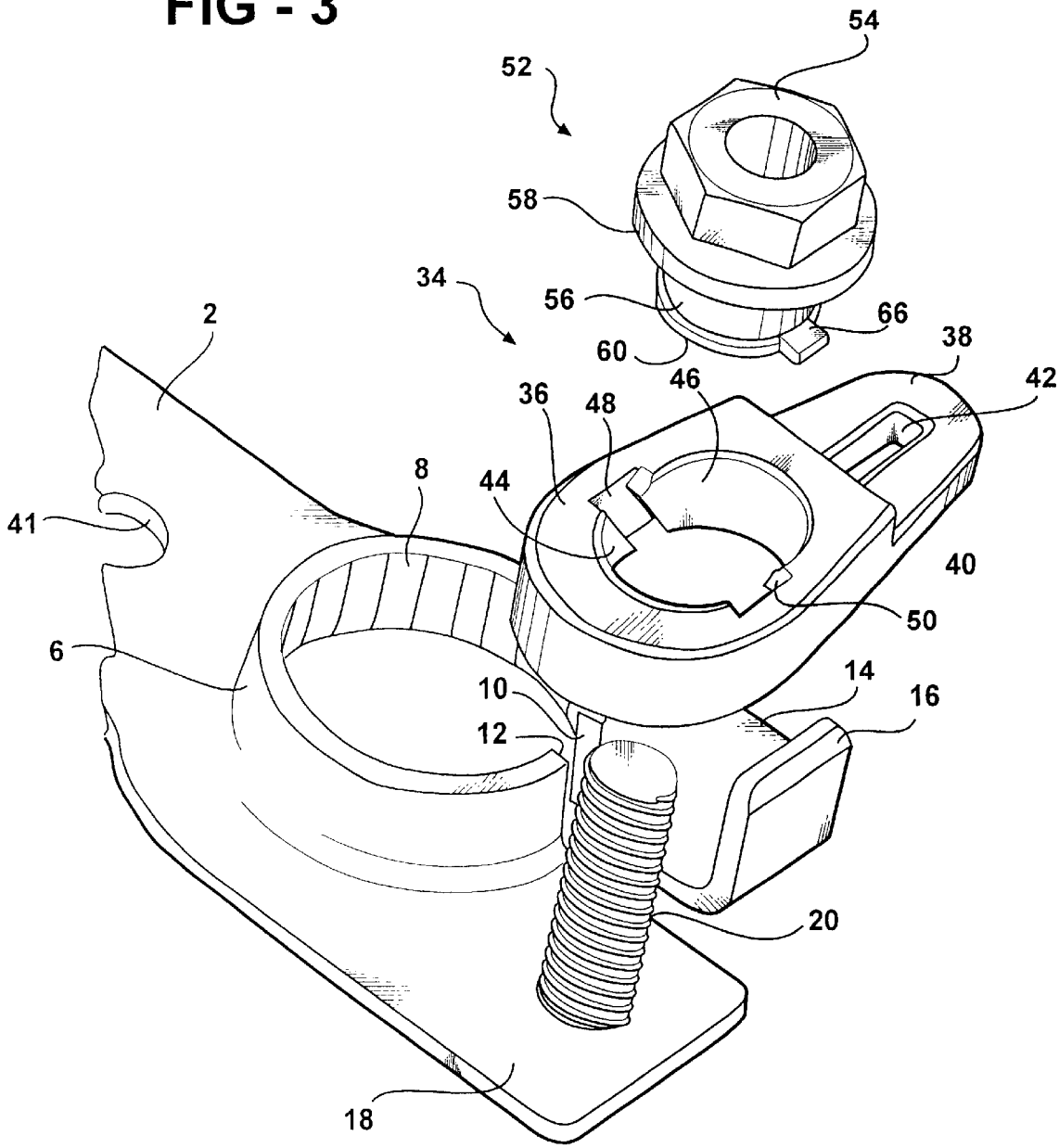
FIG. 3 is an exploded perspective of the clamping mechanism as substantially illustrated in FIG. 2.
Figure 4:
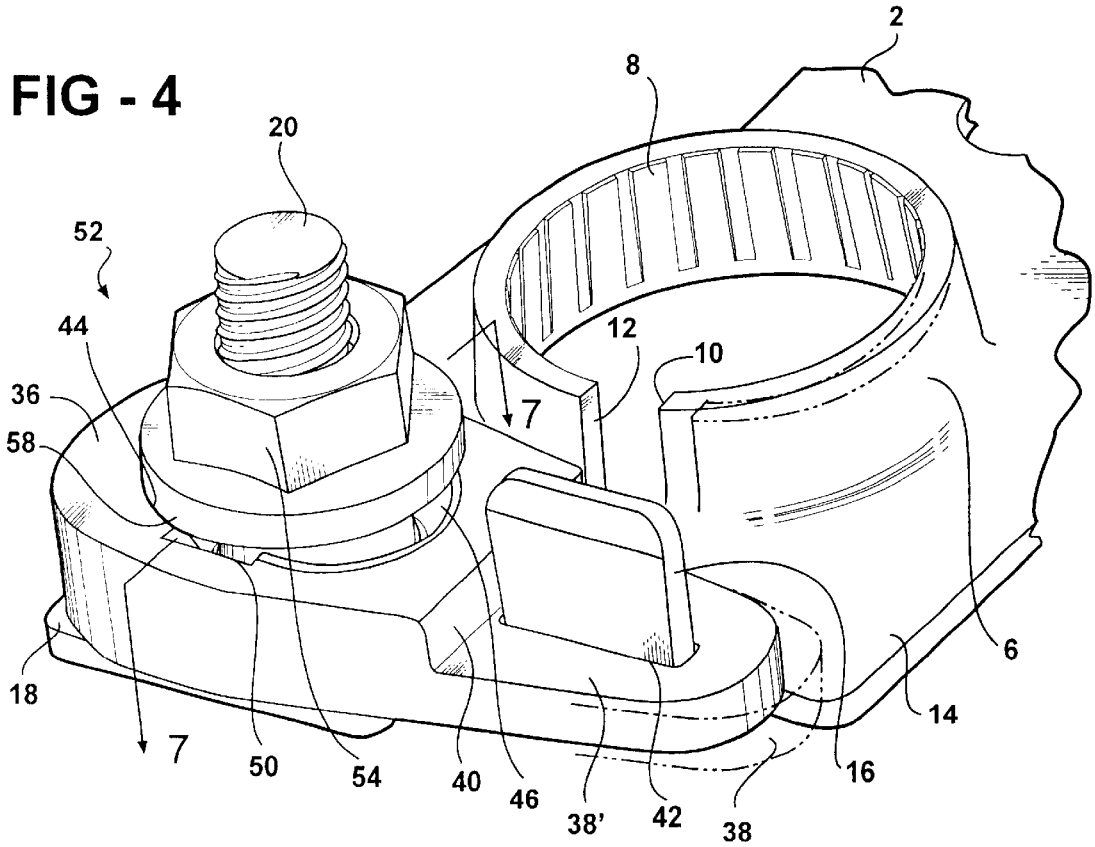
FIG. 4 is a perspective view substantially as shown in FIG. 2 and illustrating the range of laterally directed clamping motion of the slider mechanism effectuated by the travel of the nut assembly in vertically rotatable fashion along the threaded post.
Figure 7:
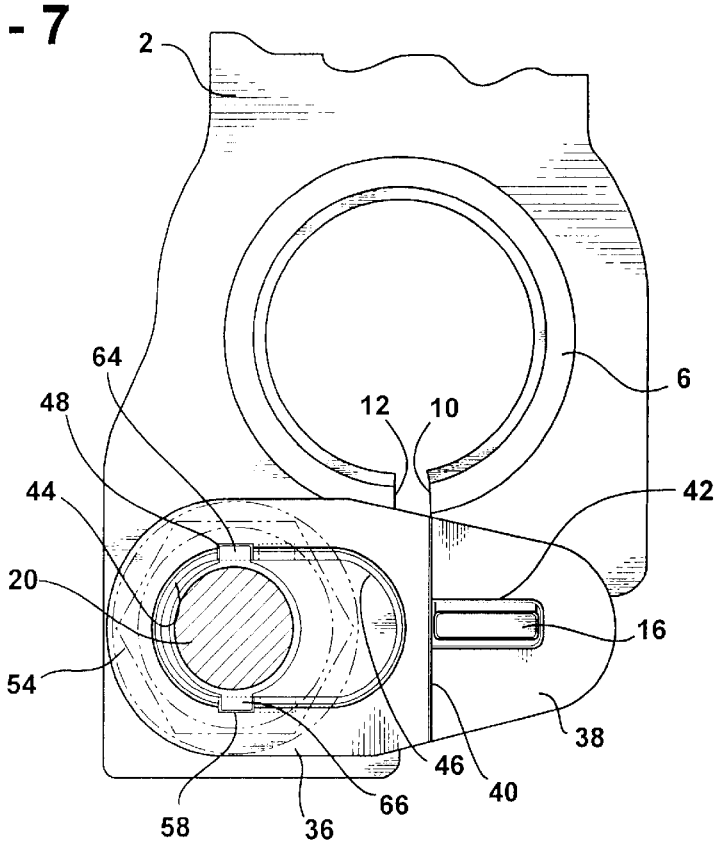
FIG. 7 is a cutaway view taken along line 7—7 of FIG. 4 and illustrating, in a downwardly looking direction, the tightened position of the hex nut with rotatable and winged washer fully seated within the downwardly angled slot recess of the slider mechanism.

Referring again to FIG. 2, as well as also to FIGS. 3 and 4, the clamping mechanism 34 includes a slider having a three dimensional and substantially elongated and arcuate shape with a first enlarged end 36 and a second narrowed end 38. In the preferred variant, the slider is constructed of a powder sintered metal, however it may also be constructed of a suitable and durable plasticized material having the necessary properties of durability and resiliency. Furthermore, the first enlarged end 36 of the slider element in the preferred variant exhibits a first three dimensional portion with substantially rounded end and the second narrowed end 38 exhibits a second integrally formed smaller, downwardly stepped (see ledge 40) and substantially rounded end.

Yet additional features of the slider include a lengthwise extending slot 42 extending therethrough proximate the second narrowed end 38, the slot 42 receiving the upwardly angled tab 16 of the battery terminal 2. A substantially elongated aperture is defined by arcuate extending inner walls 44 and 46, such further exhibiting a gradual downward and inward slope between top and bottom surfaces of the first enlarged end 38. A pair of first and second angled and recessed slots 48 and 50 are defined in generally downwardly and forwardly extending fashion on opposing sides of the aperture and by which separate the inner walls 44 and 46 as illustrated throughout the several views. As also shown, the angled slots 48 and 50 communicate with a first more rearward location at the top surface of the first enlarged end 38, as well as with a second more forwardly disposed location at with bottom surface.

Figure 1:
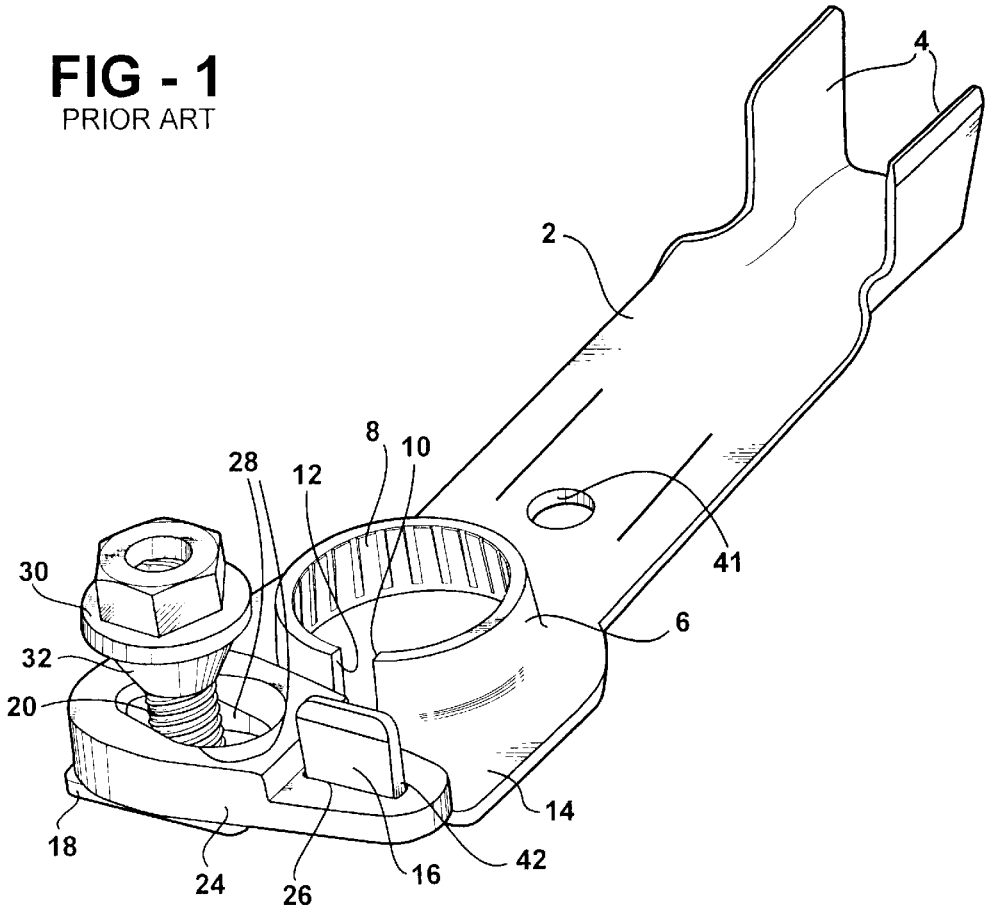
FIG - 1 PRIOR ART
FIG. 1 is a view of the Prior Art clamping mechanism in use with a battery terminal post according to the present invention.

The angled and recessed slots 48 and 50 therefore define a first pair of guiding portions defined in extending fashion along the slider and are in substitution of the otherwise tapered extending sides 28 of the prior art. The size and configuration of the arcuate extending walls 46 and 48 defining the aperture is such that the slider, as with that shown at 24 in the Prior Art illustration of FIG. 1, is capable of being seated within the upwardly extending and exteriorly threaded post 20 and supported upon the surface of the second plate 18 (or second leg) of the terminal concurrent with the slot 42 defined along the second narrowed end 38 receiving therethrough the upwardly angled tab 16 projecting from the terminating end of the first plate 14 (or first leg).

A nut assembly, see generally at 52, is provided, typically constructed of a screw machined part, cold formed carbon steel or like suitable material, and is capable of being threadably engaged over and along the threaded post 20 in first and second translating directions. The nut assembly includes, in the preferred embodiment, a hex head 54 and an integrally formed and extending cylindrically shaped portion 56. In the preferred variant, an enlarged disk-shaped portion 58 is integrally defined between the hex head 54 and the extending and cylindrically shaped portion 56.

Figure 5:
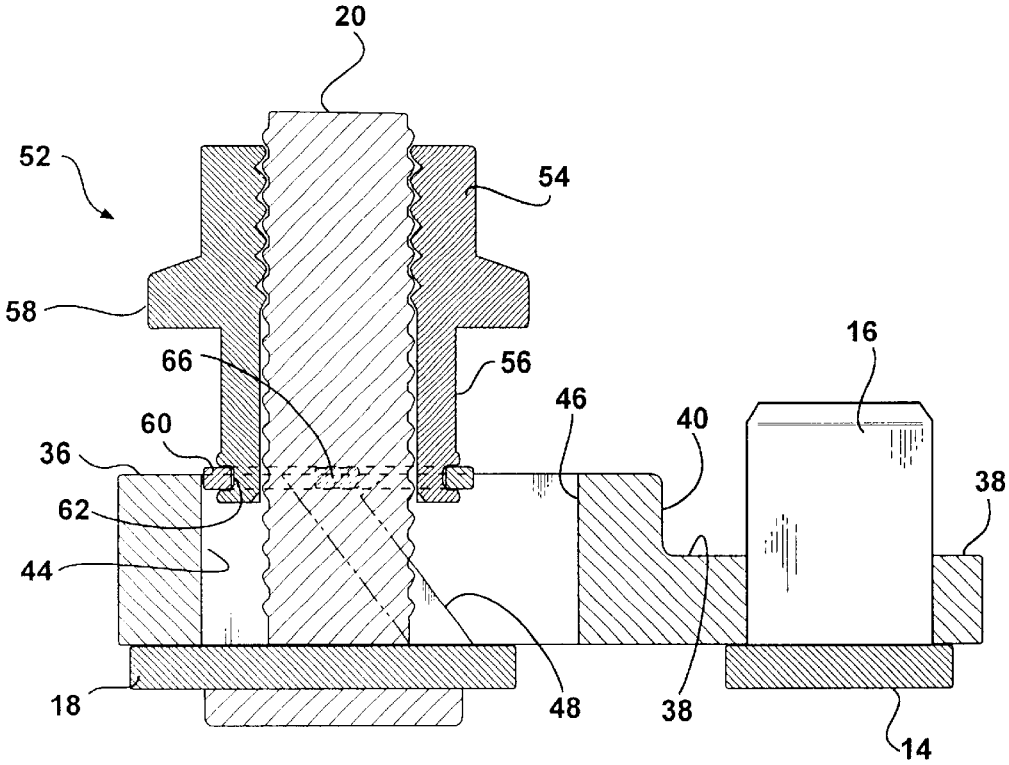
FIG. 5 is a cross sectional cutaway of the slider mechanism with threadably engageable nut assembly in a first loosened position about the terminal.
Figure 6:
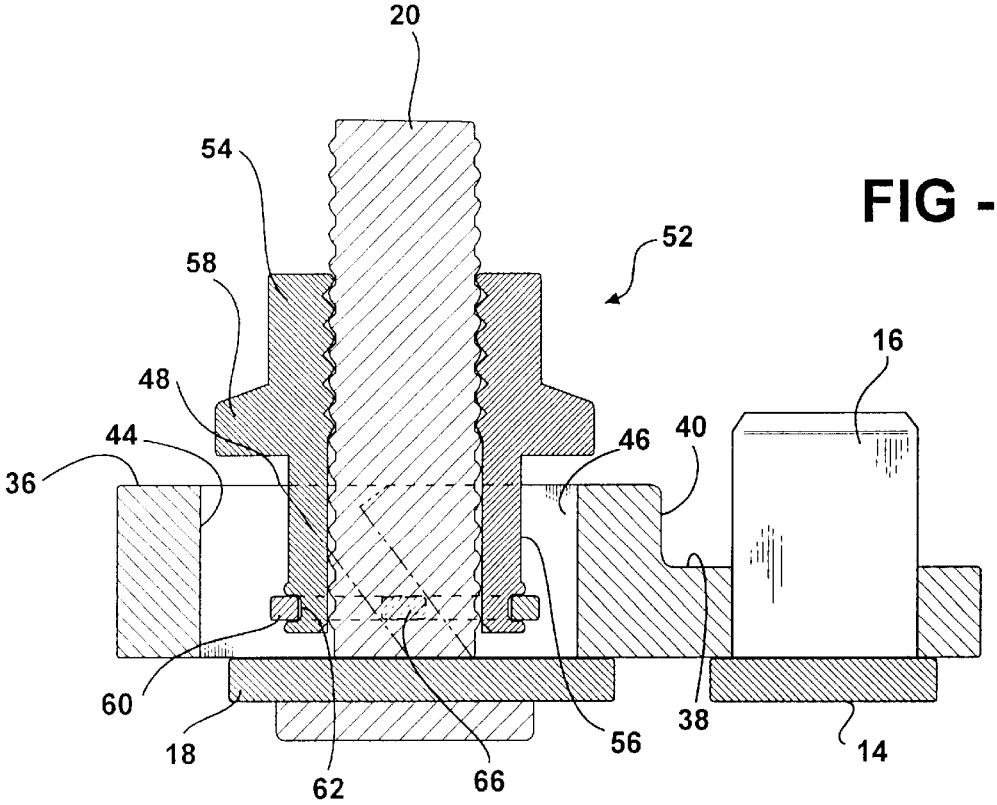
FIG. 6 is a further cross sectional cutaway of the slider mechanism illustrating the nut assembly in a second tightened position and in which the oppositely and laterally extending wings associated with the nut washer have fully traversed the angled slot recesses defined within the sides of the slider mechanism to actuate to the tightened position.

A washer 60 is secured in axially fixed and freely rotatable fashion about the cylindrical shaped portion 56 of the nut assembly 52. In the preferred variant, an annular extending recess 62 (see in particular the cutaway cross sectional views of FIGS. 5 and 6) is defined at a lower end of the cylindrical shaped portion 56 and within which is seated the washer 60 in the desired axially/translatably fixed and freely rotatable fashion. The axially fixed and rotatable washer 60 further includes a pair of laterally extending wings 64 and 66 and which defined first and second opposite extending and interengaging guides respective to the position and configuration of the angled and recessed slots 48 and 50 defined in the slider aperture.

In operation, the nut assembly 52 is, upon being threadably engaged over the upwardly extending end of the threaded post 20, rotated in a first downward translating fashion along the post and such that the extending wings 64 and 66 of the axially fixed and rotatable washer are aligned with the top communicating locations of the angled slots 48 and 50. At that point, continued rotation/downward translation of the nut assembly 52 results in the lateral wings 64 and 66 seating within their respective angled slots 48 and 50 and, as they progress downwardly and forwardly in guiding fashion therethrough, cause the slider to be laterally displaced in a sliding direction along the second leg (plate 18) which is opposite that of the first leg (plate 14).

As has also been described in reference to the Prior Art description, the travel of the slider causes the fixedly secured tab 16 associated with the first leg (or alternatively whatever structure associated with the terminal 2 that will be suitably affixed to the slider) to be drawn in a direction towards the second leg. This in turn causes the gap or separation established by the spaced apart guide walls 10 and 12 of the encircling post fitting 6 to be constricted about the associated battery post (see again at 3 in FIG. 8) such that, upon travel of the wings 64 and 66 from the initial position illustrated in FIG. 5 to the final position of FIG. 6, the clamping mechanism 34 engages the battery terminal 2 to the post 3 with a suitable and controlled degree of clamping force. Additional reference is made again to FIG. 4 and which illustrates the lateral movement of the second narrowed end of the slider from the initial loosened position 38 to the eventual tightened and laterally displaced position 38'.

In some applications, it is also understood the dimensioning and location of the integrally formed and enlarged disk shaped portion 58 of the nut assembly 52 may also seat against the top surface of the enlarged end 36 of the slider and in order to prevent excessive travel of interengaging wing portions 64 and 66 within the associated slot recesses 48 and 50, thus resulting in the undesirable over-clamping or over-torquing conditions the present invention seeks to avoid. Alternate variants further contemplate that the seating location of the wing portions 64 and 66 at the bottom of the angled slots 48 and 50, which then come into abutting contact with the top surface of the plate 18, will serve to define the adequate and maximum clamping force needed to secure the terminal post fitting about the battery post.

As also previously described, the controlled degree of clamping force regulated by the mechanism 34 prevents over-torquing of the terminal about the post and thus inevitable plastic deformation of the terminal which results therefrom. A further advantage of the initially applied and controlled clamping force is that, during reverse translational and upward rotation of the nut assembly 52 and associated washer 60 with wing portions 64 and 66, the first leg (plate 14) of the terminal 2 "springs back" from its tightened position of FIG. 6 to its initial and loosened position of FIG. 5. This is again the result of the controlled and "forced" travel of the wing portions 64 and 66 along the angled recessed slots 48 and 50 and whereby no requirement for any additional tool or utensil is indicated to retract the terminal legs and post fitting from about the battery post and which further accomplishes the desired "spring back" of the terminal legs and post fitting without damaging the typically lead construction of the battery post.

Having described the presently preferred embodiments, it is to be understood that the invention may be otherwise embodied within the scope of the appended claims.

What is claimed is:

1. A clamping mechanism for use with a terminal secured to a battery post, the terminal including a first end grippingly securing a terminal line, the terminal further including a substantially annular shaped post fitting proximate a second end which includes a pair of spaced apart guide walls in turn communicable with first and second spaced apart and extending legs, the first leg further including an upwardly extending and exteriorly threaded post, said clamping mechanism comprising:

a body adapted to being supported in laterally traversable fashion upon the first terminal leg, said body further including a substantially elongated aperture defined therethrough and so that said body is seatingly engaged through the terminal post, said body further being adapted to fixedly engage the second terminal leg;

said aperture further including at least one angling guide comprising an angled and recessed slot located along at least one selected extending wall defining said aperture and substantially along its elongated length;

a nut assembly adapted to being threadably engaged over an extending end of the terminal post, said nut assembly including at least one additional guide comprising a laterally extending wing inter-engaging, along a traveling direction, with said slot; and said nut assembly being rotated in first and second opposite and translating directions along the post and such that said inter-engaging guides actuate said body between corresponding loosened and tightened positions, said body being laterally traversed in a controlled manner and with a controlled degree of clamping force applied to the terminal upon the second leg being forcibly drawn in a direction toward the first selected leg, a controlled spring back of said body to said loosened position being accomplished upon said nut assembly being rotated in said second translating direction.

2. The clamping mechanism as described in claim 1, further comprising said body having a specified three dimensional and substantially elongated shape with a first enlarged end located proximate the first selected terminal leg and a second narrowed end located proximate said fixed engagement with the other terminal leg.

3. The clamping mechanism as described in claim 2, the first and second extending legs of the terminal further being defined as first and second plates, an upwardly angled tab extending from a terminating edge of the second plate, said body further comprising a lengthwise extending slot proximate said narrowed end and through which is adapted to being received the upwardly angled tab.

4. The clamping mechanism as described in claim 1, said nut assembly further comprising a hex head and an extending and cylindrically shaped portion, a washer being secured in axially fixed and freely rotatable fashion about said cylindrical shaped portion and upon which is supported said inter-engaging guide.

5. The clamping mechanism as described in claim 4, said angling guide further comprising first and second angling guides extending along opposing elongated sides, said washer further comprising first and second opposite extending inter-engaging guides.

6. The clamping mechanism as described in claim 5, said first and second angling guides further comprising first and second ones of said angled and recessed slots defined along and within said first and second elongated sides of said aperture.

7. The clamping mechanism as described in claim 6, said rotatable washer further comprising a pair of said laterally extending wings seating respectively within said angled and recessed slots.

8. The clamping mechanism as described in claim 4, further comprising an annular extending recess defined at a lower end of said cylindrical shaped portion and within which is seated said washer.

9. The clamping mechanism as described in claim 4, further comprising an enlarged disk-shaped portion integrally defined between said hex head and said extending and cylindrically shaped portion.

10. The clamping mechanism as described in claim 2, said first enlarged end of said body further comprising a first three dimensional portion and said second narrowed end further comprising a second downwardly stepped and three dimensional portion.

11. The clamping mechanism as described in claim 10, said body further comprising first and second rounded ends and being constructed of at least one of a plasticized material and a powder sintered metal.

12. The clamping mechanism as described in claim 9, said nut assembly exhibiting a specified three dimensional shape and being constructed of at least one of a screw machined part and a cold formed carbon steel.

13. A combination clamping mechanism and battery terminal for securing to a battery post, a terminal line extending in proximity to the battery post, said combination comprising:

said terminal comprising a first end grippingly securing the terminal line, said terminal further including a substantially annular shaped post fitting proximate a second end thereof and which includes a pair of spaced apart guide walls in turn communicable with first and second spaced apart and extending legs, said first leg further including an upwardly extending and exteriorly threaded post;

said clamping mechanism comprising a three dimensional and substantially elongated slider supported in laterally traversable fashion upon said first terminal leg, said slider further including a substantially elongated aperture defined therethrough and so that said slider is seatingly engaged through said terminal post, said slider fixedly engage said second terminal leg;

said slider aperture further including at least one angling guide comprising an angled and recessed slot located along at least one selected extending wall defining said aperture and substantially along its elongated length;

a nut assembly threadably engaging over an extending end of said terminal post, said nut assembly including at least one additional guide comprising a laterally extending wing inter-engaging along a traveling direction, with said slot; and said nut assembly being rotated in first and second opposite and translating directions along the post and such that said inter-engaging guides actuate said slider between corresponding loosened and tightened positions, said slider being laterally traversed in a controlled manner and with a controlled degree of clamping force applied to said terminal upon said second leg being forcibly drawn in a direction toward said first selected leg, a controlled spring back of said body to said loosened position being accomplished upon said nut assembly being rotated in said second translating direction.

14. A clamping mechanism for use with a terminal secured to a battery post, the terminal including a post fitting having a pair of spaced apart guide walls communicable with first and second spaced apart and extending legs, said clamping mechanism comprising:

a body supported in laterally traversable fashion upon the first terminal leg and fixedly engaged to the second terminal leg;

at least one guide comprising an angled and recessed slot extending in three dimensional fashion along said body;

a nut assembly including at least one additional guide comprising a laterally extending wing inter-engaging, along a traveling direction, with said slot associated with said body; and said nut assembly being vertically translated in opposite directions such that said inter-engaging guides actuate said body between corresponding loosened and tightened positions, said body being laterally traversed in a controlled manner and with a controlled degree of clamping force applied to the terminal upon said nut assembly being translated in a first selected direction whereupon the second leg is forcibly drawn in a direction toward the first selected leg, a controlled spring back of said body to said loosened position being accomplished upon said nut assembly being translated in a second opposite direction.

* * * * *